US007695208B2

(12) United States Patent
Gutberlet

(10) Patent No.: US 7,695,208 B2
(45) Date of Patent: Apr. 13, 2010

(54) APPLICATOR DEVICE FOR APPLICATION OF A LIQUID MEDIUM

(75) Inventor: Detlev Gutberlet, Altdorf (DE)

(73) Assignee: H & M Gutberlet GmbH, Nürnberg (DE)

( * ) Notice: Subject to any disclaimer, the term of this patent is extended or adjusted under 35 U.S.C. 154(b) by 0 days.

(21) Appl. No.: 12/175,204

(22) Filed: Jul. 17, 2008

(65) Prior Publication Data

US 2009/0022542 A1 Jan. 22, 2009

(30) Foreign Application Priority Data

Jul. 17, 2007 (DE) ..... 20 2007 010 060 U

(51) Int. Cl.
*A46B 11/00* (2006.01)

(52) U.S. Cl. ..... 401/126; 401/122

(58) Field of Classification Search ..... 401/118, 401/121, 122, 126–130; 132/317
See application file for complete search history.

(56) References Cited

U.S. PATENT DOCUMENTS 2,193,509 A * 3/1940 Deakers et al. ..... 401/126
4,929,108 A * 5/1990 Gueret ..... 401/126
4,930,919 A * 6/1990 Gueret ..... 401/126
4,984,918 A * 1/1991 Iizuka et al. ..... 401/4

FOREIGN PATENT DOCUMENTS

| | | | |
|---|---|---|---|
| DE | 9106771 | U1 | 12/1991 |
| DE | 19927417 | A1 | 12/2000 |
| EP | 0743830 | B1 | 11/1996 |

* cited by examiner

*Primary Examiner*—David J Walczak
(74) *Attorney, Agent, or Firm*—Browdy and Neimark, PLLC

(57) ABSTRACT

An applicator device serves for application of a liquid medium. The applicator device has a reservoir for the medium and an applicator. The applicator is surrounded by a protective sleeve in the reservoir. The protective sleeve is rigidly connected with the reservoir. The inner diameter of the protective sleeve is constant in the vicinity of an applicator tip of the applicator and exceeds the outer diameter of the applicator penetrating into the reservoir. The protective sleeve extends down to a bottom of the reservoir and bears against the bottom via a resilient sleeve portion. As a result, an applicator device is obtained which provides for protection of the applicator tip and is easy to fabricate.

11 Claims, 2 Drawing Sheets

APPLICATOR DEVICE FOR APPLICATION OF A LIQUID MEDIUM

BACKGROUND OF THE INVENTION

1. Field of the Invention

The invention concerns an applicator device for applying a liquid medium comprising a reservoir for the medium, an applicator, a protective sleeve which surrounds the applicator in the reservoir and is rigidly connected with the reservoir, wherein the inner diameter of the protective sleeve is constant in the vicinity of an applicator tip of the applicator and exceeds the outer diameter of the applicator penetrating into the reservoir.

2. Background of the Invention

An applicator device of this type is disclosed in EP 0 743 830 B1. The fabrication of an applicator device of this type is rather complex.

SUMMARY OF THE INVENTION

It is an object of the present invention to develop an applicator device of the above type such that a protection of an applicator tip is provided while simplifying the fabrication thereof.

This object is achieved according to the invention by an applicator device with a protective sleeve that extends down to a bottom of the reservoir and bears against the bottom via a resilient sleeve portion.

The invention is based on the fact that a protection for the applicator tip need not necessarily be formed such as to complement the applicator tip. It is sufficient if the protective sleeve surrounds the applicator tip such that a damage to or an unwanted deformation of the applicator tip caused by rapidly flowing medium or a mixing member, which may be provided in the reservoir, is virtually excluded. A protective function of this type may also be fulfilled by a protective sleeve whose inner diameter is constant in the vicinity of an applicator tip, i.e. not complementary to the applicator tip. The fabrication of a protective sleeve of this type requires a comparatively low amount of effort due to its constant inner diameter in the vicinity of the applicator tip. Owing to the resilient sleeve portion, the protective sleeve automatically adapts to the height of the reservoir. It is therefore possible to use one and the same protective sleeve for reservoirs having different heights, thereby reducing the effort involved in the fabrication of the protective sleeve.

A protective sleeve in which a rigid portion thereof forms one piece with the resilient sleeve portion of the applicator device may be fabricated using mass production methods without requiring assembly of individual parts. Alternatively, the resilient sleeve portion may be fabricated separately from the rigid portion of the protective sleeve before subsequently being attached to the rigid portion. The resilient sleeve portion may for example be fabricated from metal.

Geometries of the resilient sleeve portion wherein the resilient sleeve portion is helical-shaped or wherein the resilient sleeve portion has ring elements which are partially spaced from one another by spring gaps and are elastically displaceable relative to each other proved to be particularly suitable for the fabrication of the resilient function that is preferred for adaptation to the height of the reservoir.

The formation of the resilient sleeve portion in which adjacent ring elements are formed in one piece only requires a small amount of effort. The entire resilient sleeve portion comprising the ring portions may in particular be formed as one piece from plastics material. Said resilient sleeve portion may again form one piece with the rigid portion.

A snap-in locking connection which connects the protective sleeve with the reservoir results in a simple assembly of the applicator device. The snap-in locking connection is formed by complementary snap-in locking portions on the protective sleeve on the one hand and on the reservoir on the other. The protective sleeve may have a circumferential groove, and the reservoir may have a complementary circumferential bead, for example. Conversely, in another embodiment of the snap-in locking connection, the reservoir may have the circumferential groove, and the protective sleeve may have the complementary circumferential bead. The snap-in locking connection results in a secure mounting in particular of a protective sleeve which is compressed in small reservoirs when mounted. The protective sleeve may principally also form one piece with the reservoir. This is in particular desired if the protective sleeve and the reservoir are made of the same plastics material.

Hook elements engaging behind a circumferential step of the reservoir for securing the protective sleeve to the reservoir enable the protective sleeve to be securely connected inside the reservoir. If hook elements of this type are used, a snap-in locking connection for connecting the protective sleeve with the reservoir may be dispensed with.

A design of the hook elements in which the hook elements form one piece with a rigid portion of the protective sleeve is cost-effective.

A stop member of the applicator for limiting the penetration depth of the applicator entering the reservoir is a simple means for limiting the penetration depth of the applicator. A limitation of this type may also be achieved by means of a screw connection between the applicator and the reservoir as it is principally known from prior art.

A protective sleeve acting as a counter stop member for the applicator stop member is an advantageous combination of several functions. The protective sleeve may for example be fabricated from a harder material than the rest of the reservoir, thus being particularly well-suited for fulfilling the function of a counter stop member.

An embodiment of the invention is hereinafter described in more detail by means of the drawing.

DESCRIPTION OF THE PREFERRED EMBODIMENTS

Figure 1:
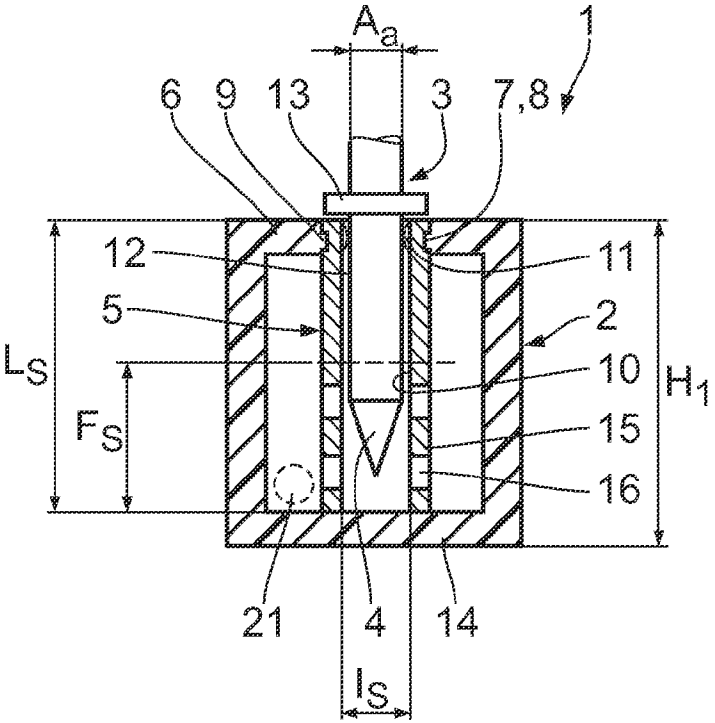
FIG. 1 shows an applicator device for applying a liquid medium, the Figure showing a vertical longitudinal section of a reservoir for the medium and a side view of a lower portion of the applicator.

An applicator device 1 according to FIG. 1 serves for application of a liquid medium which is stored in a reservoir 2. The liquid medium may be a cosmetic medium or another medium such as a correction fluid or an ink. The reservoir 2 is made of plastics material. Alternatively, the reservoir 2 may also be made of glass or metal. The applicator device 1 has an applicator 3 of which only a lower portion but not, however, an upper portion comprising an applicator handle is shown in FIG. 1. At its end penetrating into the reservoir 2, the applicator 3 has an applicator tip 4 for applying the medium, the applicator tip 4 being formed in the manner of a paintbrush, for example. Likewise, the applicator tip 4 may be formed in the manner of a sponge or in any other manner suitable for application of the medium.

In the reservoir 2, the applicator 3 is surrounded by a protective sleeve 5. The latter consists of the polymer polypropylene (PP). Alternatively, the protective sleeve 5 may also be fabricated from polyoxymethylene (POM).

It is however also possible for the protective sleeve 5 to be fabricated from another soft plastic such as soft polyethylene (PE). In the vicinity of an upper reservoir wall 6 of the reservoir 2, the protective sleeve 5 is connected to the reservoir 2 by means of a snap-in locking connection 7. The snap-in locking connection includes a circumferential groove 8 in the protective sleeve 5 which is engaged by a circumferential spring or circumferential bead 9, respectively, which is complementary thereto and forms one piece with the upper reservoir wall 6. At the height of the snap-in locking connection 7, the protective sleeve 5 defines an inlet opening for the applicator 3 to enter the reservoir 2. At this height, a sealing ring 11 may be formed on an inner wall 10 of the protective sleeve 5, this sealing ring 11 being indicated by dashes in FIG. 1. The sealing ring 11 seals the inner wall 10 against an outer wall 12 of the applicator 3.

A penetration depth of the applicator 3 entering the reservoir 2 is limited by a stop collar 13 which is securely connected to the applicator 3 and may form one piece therewith. In the deepest penetration position of the applicator 3, the stop collar 13 comes to rest against an upper front wall of the protective sleeve 5.

With the exception of the sealing ring 11, an inner diameter $I_S$ of the protective sleeve 5 is constant. In particular, the inner diameter $I_S$ is constant near the applicator tip 4 in the deepest penetration position shown in FIG. 1. This inner diameter $I_S$ exceeds the outer diameter $A_a$ of the applicator 3 penetrating into the reservoir 2, the applicator 3 thus being disposed inside the protective sleeve 5.

The protective sleeve 5 extends down to a bottom 14 of the reservoir 2, thus bearing against the latter via a resilient sleeve portion 15. In the position of the protective sleeve 5 according to FIG. 1 in which the resilient sleeve portion 15 is virtually completely decompressed, an axial extension $F_S$ of the resilient sleeve portion 15 amounts to approximately half of the entire axial length $L_S$ of the protective sleeve 5. In this decompressed position, the resilient sleeve portion 15 has extended spring gaps 16.

Figure 3:
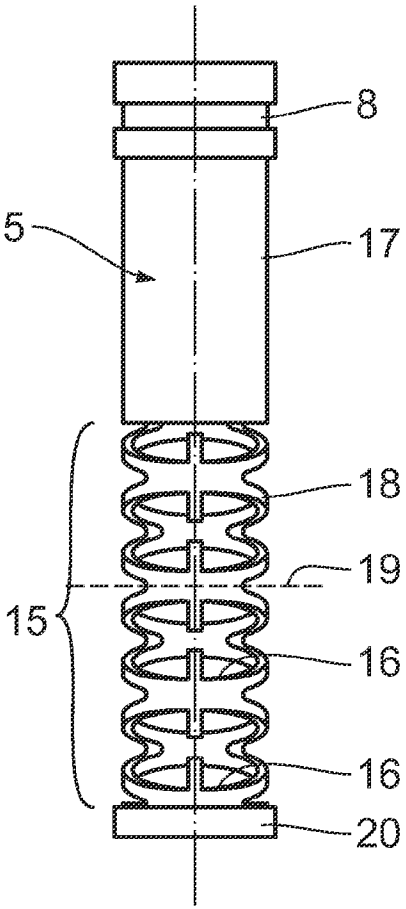
FIG. 3 shows a more detailed and enlarged view of a protective sleeve which surrounds the applicator in the reservoir of the embodiments according to FIGS. 1 and 2.

FIG. 3 shows a more detailed view of the protective sleeve 5. The resilient sleeve portion 15 forms one piece with a hollow cylindrical rigid portion 17 of the protective sleeve 5. The resilient portion 15, i.e. the resilient sleeve portion, has a multitude of ring elements 18 which are spaced from one another by the spring gaps 16 and are elastically displaceable relative to each other, the number of ring elements 18 amounting to a total of seven in the displayed embodiment according to FIG. 3. During the resilient movement of the resilient sleeve portion 15, adjacent ring elements 18 rotate about fixed-joint axes 19 which are defined by the attachment portions of two adjacent ring elements 18.

The protective sleeve 5 has an annular end collar 20 enabling the former to rest on the ground 14.

Figure 2:
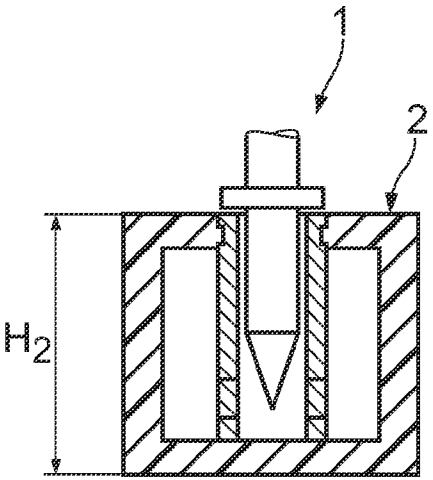
FIG. 2 shows a representation, similar to that of FIG. 1, of an applicator device comprising a reservoir of a lower depth when compared to the applicator device of FIG. 1.

FIG. 2 shows another embodiment of an applicator device 1. Components which are equal to those described above with reference to FIGS. 1 and 3 are designated by the same reference numerals and are not described again.

The only difference between the applicator device 1 according to FIG. 2 and that of FIG. 1 lies in the height H of the reservoir 2. This height $H_1$ of the reservoir 2 according to FIG. 1 exceeds that of the reservoir 2 according to FIG. 2 (height $H_2$).

The applicator device 1 according to FIG. 2 also utilizes the protective sleeve 5 according to FIG. 3 with the same decompressed axial extension as the protective sleeve 5 of the applicator device 1 according to FIG. 1. Due to the lower height $H_2$ of the reservoir 2 according to FIG. 2, the resilient sleeve portion 15 is virtually completely compressed in the mounted position of the protective sleeve 5 shown in FIG. 2, resulting in small spring gaps 16 if there are any at all. The different reservoir heights $H_1$, $H_2$ may thus be compensated for by the compression of the resilient sleeve portion 15. Even in the completely compressed position of the resilient sleeve portion 15 according to FIG. 2, a sufficient passage of liquid medium is still possible between the reservoir interior surrounding the protective sleeve and the interior of the protective sleeve 5.

In the applicator devices 1 according to FIGS. 1 and 2, the protective sleeve 5 fulfills the same function by providing for protection of the applicator tip 4. The protective sleeve 5 in particular prevents a mixing ball 21 (cf. FIG. 1), which may be provided in the reservoir 2, from coming into contact with and thereby deforming the applicator tip 4 since the size of the spring gaps 16 is smaller than the diameter of the mixing ball 21.

Instead of the embodiment of the protective sleeve 5 shown in FIG. 3, the protective sleeve 5 of the resilient sleeve portion 15 may also have a helical shape in the manner of a helical curve, causing spring gaps to be created as a result of the distance of the adjacent individual flights of such a spring helix.

In an alternative embodiment (not shown) of the protective sleeve 5, the resilient sleeve portion 15 does not form one piece with the rigid portion 17 but the resilient sleeve portion 15 is a separate spring that is connected with the rigid portion 17. The spring may for example be a helical spring of metal. Principally, the entire protective sleeve 5 may be fabricated from metal.

Alternative embodiments for securing the protective sleeve 5 in the reservoir 2 are hereinafter described in more detail by means of FIGS. 4 and 5. Components that are equal to those described above with reference to FIGS. 1 to 3 are designated by the same reference numerals and are not described again.

Figure 4:
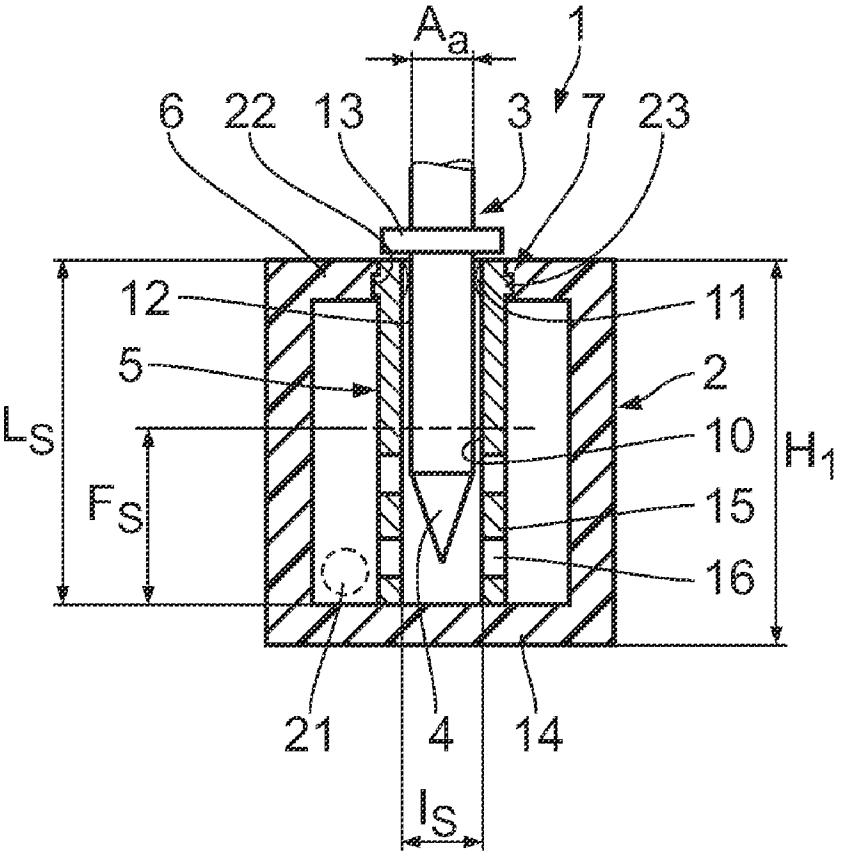
FIG. 4 shows a representation, similar to that of FIG. 1, of an alternative version of a snap-in locking connection for securing the protective sleeve in the reservoir.

In the embodiment according to FIG. 4, the snap-in locking connection 7 includes a circumferential groove 22 in the housing 2. This circumferential groove 22 is engaged by a complementary circumferential spring or circumferential bead 23, respectively, that forms one piece with a portion of the protective sleeve 5, this portion being disposed at the height of the upper reservoir wall 6.

Figure 5:
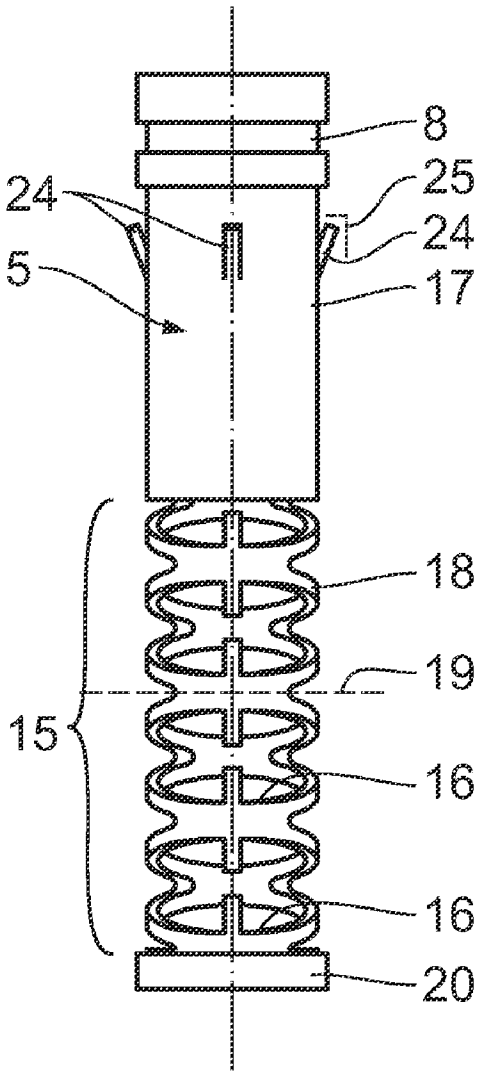
FIG. 5 shows a representation, similar to that of FIG. 3, of another alternative version of a securing connection for securing the protective sleeve in the reservoir.

In the embodiment according to FIG. 5, several hook elements 24 form one piece with the rigid portion 17 of the protective sleeve 5, the number of hook elements 24 amounting to three in the present example. The three hook elements are disposed about the longitudinal axis of the protective sleeve 5 in an equally distributed manner when seen in the circumferential direction. Free ends of the hook elements 24 extend from the rigid portion 17 at an angle towards the upper reservoir wall 6 when the protective sleeve 5 is mounted. When the protective sleeve 5 is mounted, the hook elements 24 engage behind a circumferential step 25 in the inner wall of the upper reservoir wall 6 facing the protective sleeve 5, the circumferential step 25 being indicated by dashes in FIG. 5. If hook elements in the manner of the hook elements 24 are provided for securing the protective sleeve 5 in the reservoir 2, a groove/spring snap-in locking connection as described above in relation to FIGS. 4 and 5 may be dispensed with.

What is claimed is:

1. An applicator device (1) for applying a liquid medium comprising a reservoir (2) for the medium;

an applicator (3);

a protective sleeve (5) to prevent a damage or an unwanted deformation of the applicator (3) caused by rapidly flowing medium or a mixing member which surrounds the applicator (3) in the reservoir (2) and is rigidly connected with the reservoir (2), wherein the inner diameter ($I_S$) of the protective sleeve (5) is constant in the vicinity of an applicator tip (4) of the applicator (3) and exceeds the outer diameter ($A_a$) of the applicator (3) penetrating into the reservoir (2), wherein the protective sleeve (5) extends down to a bottom (14) of the reservoir (2) and bears against the bottom (14) via a resilient sleeve portion (15), and wherein in a position of the protecting sleeve (5) in which the resilient sleeve portion (15) is decompressed, an axial extension ($F_S$) of the resilient sleeve portion (15) amounts to approximately half of the entire axial length ($L_S$) of the protective sleeve (5).

2. An applicator device according to claim 1, wherein the resilient sleeve portion (15) forms one piece with a rigid portion (17) of the protective sleeve (5).

3. An applicator device according to claim 1, wherein the resilient sleeve portion (15) is helical-shaped.

4. An applicator device according to claim 1, wherein the resilient sleeve portion (15) has ring elements (18) which are partially spaced from one another by spring gaps (16) and are elastically displaceable relative to each other.

5. An applicator device according to claim 4, wherein adjacent ring elements (18) are formed in one piece.

6. An applicator device according to claim 1, wherein the protective sleeve (5) is connected with the reservoir (2) by means of a snap-in locking connection (7).

7. An applicator device according to claim 1, wherein the protective sleeve is secured to the reservoir (2) by means of hook elements (24) which engage behind a circumferential step (25) of the reservoir (2).

8. An applicator device according to claim 7, wherein the hook elements (24) form one piece with a rigid portion (17) of the protective sleeve (5).

9. An applicator device according to claim 1, wherein the applicator (3) has a stop member (13) which limits the penetration depth of the applicator (3) entering the reservoir (2).

10. An applicator device according to claim 9, wherein the protective sleeve (5) is a counter stop member for the applicator stop member (13).

11. An applicator device (1) for applying a liquid medium comprising a reservoir (2) for the medium;

an applicator (3);

a protective sleeve (5) to prevent a damage or an unwanted deformation of the applicator (3) caused by rapidly flowing medium or a mixing member which surrounds the applicator (3) in the reservoir (2) and is rigidly connected with the reservoir (2), wherein the inner diameter ($I_S$) of the protective sleeve (5) is constant in the vicinity of an applicator tip (4) of the applicator (3) and exceeds the outer diameter ($A_a$) of the applicator (3) penetrating into the reservoir (2), wherein the protective sleeve (5) extends down to a bottom (14) of the reservoir (2) and bears against the bottom (14) via a resilient sleeve portion (15), and wherein the resilient sleeve portion (15) forms one piece with a rigid portion (17) of the protective sleeve (5), and wherein in a position of the protecting sleeve (5) in which the resilient sleeve portion (15) is decompressed, an axial extension ($F_S$) of the resilient sleeve portion (15) amounts to approximately half of the entire axial length ($L_S$) of the protective sleeve (5).

* * * * *